United States Patent [19]

Spooner et al.

[11] 3,933,066

[45] Jan. 20, 1976

[54] DUAL SPEED STACKER PADDLE ASSEMBLY

[75] Inventors: Robert J. Spooner; Oscar W. Dillon, both of Essex, Conn.

[73] Assignee: Cashin Systems Corporation, Williston Park, N.Y.

[22] Filed: Feb. 26, 1975

[21] Appl. No.: 553,144

[52] U.S. Cl. ..... 83/92; 83/157; 83/340

[51] Int. Cl.[2] ..... B26D 4/46

[58] Field of Search ..... 83/92, 91, 157, 340

[56] References Cited

UNITED STATES PATENTS

| | | | |
|---|---|---|---|
| 1,630,099 | 5/1927 | VanBerkel | 83/92 |
| 3,318,351 | 5/1967 | Werder | 83/92 |
| 3,821,913 | 7/1974 | Bajear et al. | 83/92 |

*Primary Examiner*—Frank T. Yost

*Attorney, Agent, or Firm*—Kane, Dalsimer, Kane, Sullivan and Kurucz

[57] ABSTRACT

A dual speed stacker assembly for use in connection with a high speed machine for slicing, stacking and weighing food products, which stacker has mating paddles which move at slow speed during the collection of the required number of slices in a stack and then are rotated at high speed to drop the stack of slices onto a conveyor and bring the blades into position to receive the next collection of slices, the said paddles being rotated by a low inertia D. C. motor connected by a timing belt and bevel gear arrangement.

14 Claims, 8 Drawing Figures

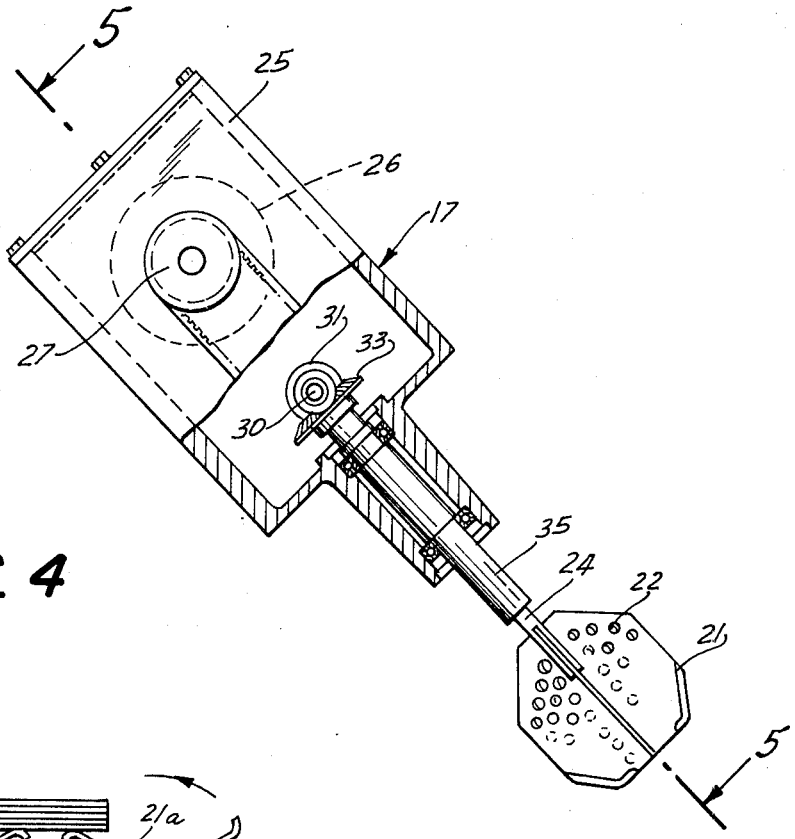
FIG. 4
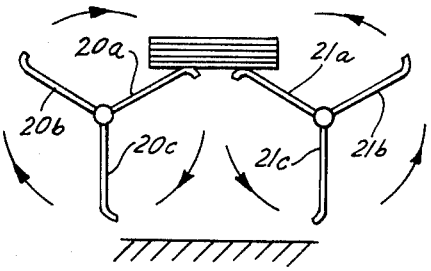
FIG. 6a
FIG. 6b
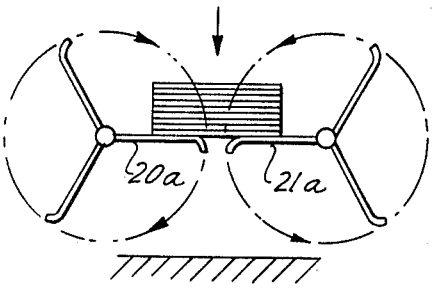
FIG. 6c
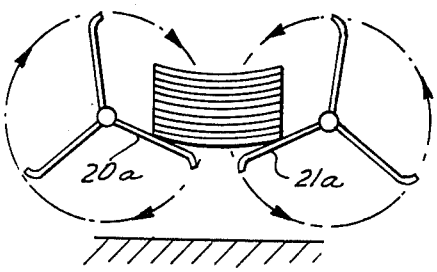

DUAL SPEED STACKER PADDLE ASSEMBLY

BACKGROUND OF THE INVENTION

In commonly assigned U.S. Pat. Nos. 3,200,864 and 3,204,676 there is described apparatus for stacking and weighing-while-conveying slices of cold cuts coming from the discharge end of the slicing machine. The stacker of such apparatus embodies mating paddles having vanes or blades which are stopped to receive a selected number of slices. When the selected number of slices have been deposited on the vanes by the slicing machine, the paddles are flipped to deposit the accumulated stacked slices onto the receiving surface of a weigh conveyor.

While the apparatus of the type disclosed in the foregoing patents has proven to be eminently satisfactory, it is desirable to upgrade their operation and efficiency. A dual speed stacker rotated by a clutch drive has been in use, but such stacker has certain shortcomings. The dual speed stacker assembly and motor drive of the present invention is an improvement over the stacker of the aforesaid patents and stackers now in use.

SUMMARY OF THE INVENTION

It is an object of the invention to provide a paddle stacker assembly for a high speed machine for slicing, stacking and weighing food products, which stacker has mating paddles with spaced blades adapted to rotate by means of a low inertia D. C. motor at a slow speed during the collection of a selected number of slices in a stack on the blades and then to rotate at a high speed to deposit the accumulated stacked slices onto a conveyor and bring another pair of blades into position to receive the next collection of slices.

It is a further object to provide in such paddle stacker a pair of mating paddles with blades so spaced that they can be rotated at slow speed to collect a tall stack of slices and at high speed to deposit such stack onto a conveyor without causing distruption, poor appearance or destruction of the stack.

It is a further object to provide in such paddle stacker a pair of mating paddles with the blades on each paddle spaced 120° apart to permit the paddles to be rotated at a slow speed to collect a tall stack of slices on a pair of blades and at a high speed faster than the gravitational drop of the stack to deposit the stack on a conveyor without the next pair of blades striking the top corners of the stack.

It is a further object to provide in such paddle stacker a pair of mating paddles with the blades on each paddle positioned and rotated at a slow speed during the collection of the slices in a stack to cause the top corners of a tall stack to be much lower with respect to the center of rotation of the two paddles and to bring the entire stack closer to the scale conveyor before it is finally dropped, thereby causing less oscillation of the scale with a more accurate reading.

BRIEF DESCRIPTION OF THE DRAWINGS

Other objects and advantages will become apparent from the following detailed description of a somewhat preferred embodiment of the invention which is to be taken in conjunction with the accompanying drawings, in which:

FIG. 4 is a side elevational view, partly in section, of the paddle box;

FIG. 6*a* is a sectional view of the blades of the paddle showing the position of the blades after the high speed flip has been completed and the blades are beginning to rotate at low speed and are ready to receive the first slice;

FIG. 6*b* is a view similar to that of FIG. 6*a* with the paddles being rotated at low speed and receiving additional slices;

FIG. 6*c* is a view similar to FIG. 6*b* showing the blades and stack of slices upon completion of the low speed rotation and preparatory to rotating at high speed and dropping the stack onto a conveyor for removal or weighing.

DESCRIPTION OF THE PREFERRED EMBODIMENT

Figure 1:
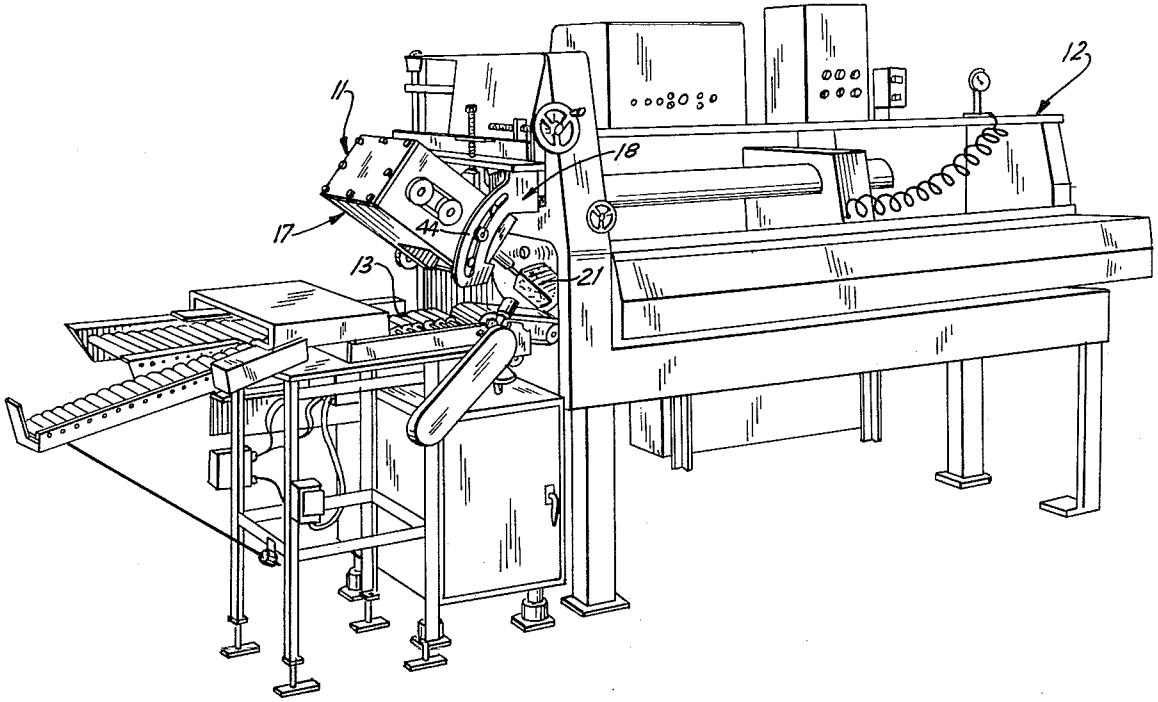
FIG. 1 is an isometric view of the machine for slicing, stacking and weighing sliced food products, which machine embodies the dual speed stacker paddle assembly of the present invention.

Referring to the drawings, FIG. 1, the weighing-while-conveying apparatus 10 and stacker 11 are shown applied to the discharge end of a slicing machine 12, so that the sliced products from the slicing machine are discharged onto the stacker and from thence on to the weighing apparatus in accordance with the selected and established measure, whether it be six, eight or more slices per stacked group. The stacks are then weighed and segregated from the other slices coming from the slicing machine, as well as the stacks formed by the stacker 11. The stacks of sliced products are then transferred to further packaging stations by a conveyor 13 if of prescribed weight, or on the other hand, to a reject station, at which point the proper weight is made, by a reject mechanism if not within the preset tolerance. In this connection, the packaging station may adopt any one of a number of commercial wrapping or packaging apparatus or techniques, using Saran, cellopane or other types of film.

Figure 2:
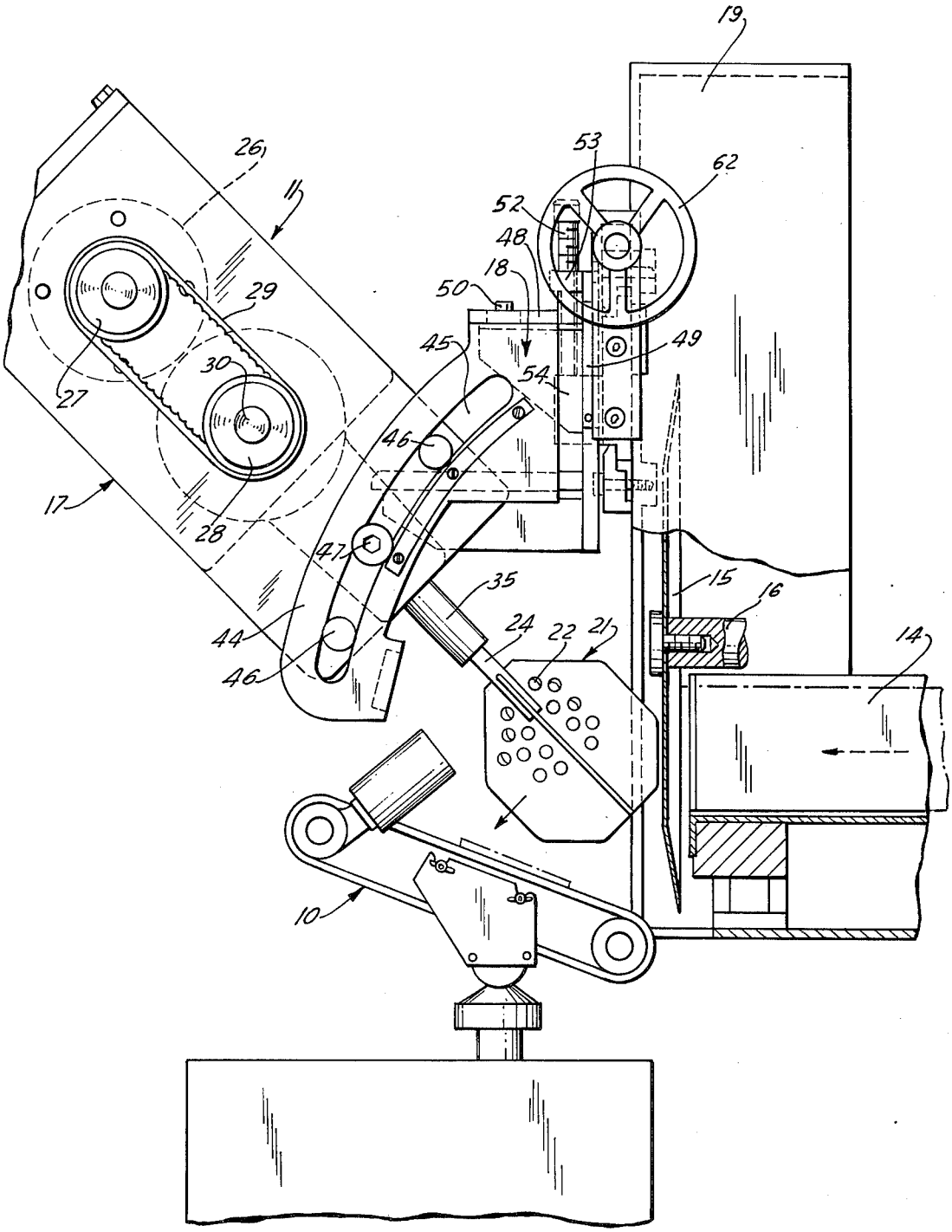
FIG. 2 is a side elevational view of the paddle box, yoke and weigh conveyor with relation to the slicer.

The blade or knife 15 is one conventional type of rotary cutter blade and is in the form of an eccentric disc or dished blade, which is adapted to be rotated at relatively high speeds (FIG. 2). Although both types of knives perform satisfactorily the dished blade is somewhat preferred. The portion of the blade having the greatest radius serves to slice the leading edge of the product 14 while the portion of the blade having the minimum radius provides clearance for the product to be fed outwardly thereby permitting the initiation of the next slicing operation. The product 14 is continuously fed forwardly by a pusher and each cycle of rotation of the blade produces another slice. The speed of operation of slicer 12 can be set for 400 to 1500 r.p.m. with the adjustment being somewhat dependent upon stacker efficiency and the particular product 14 to be sliced.

The blade 15 is mounted at the end of a rotatable shaft 16, which is suitably journalled; and the shaft in turn may be driven by an electric motor through suitable drive mechanism. Such motor and mechanism are interconnected and synchronized with the continuous movement of the pusher for the meat to assure uniform thickness of the slices. There is also an interconnection between the speed of feed of the pusher and the weigh-while-convey apparatus 10 in order that the speed of feed of the pusher can be adjusted to correspondingly change the slice thickness and thereby maintain the weight of the stacked slices within the prescribed limits.

SLICING MACHINE

My invention may utilize any one of several different types of slicing machines presently existing on the market. The drawings (FIG. 1) illustrate one type of slicing machine 12 to which my invention is applicable. However, it should be understood that the illustrated slicing machine does not per se constitute the present invention.

One slicing machine is available commercially under the name Anco No. 832 Cold Cut Slicer and is fully disclosed in the operating instructions for the Anco No. 832 Hydramatic Shear-Cut Slicer (dated Sept. 17, 1959), published by the manufacturer, the Allbright-Nell Co. of Chicago, Illinois, as well as commonly assigned U.S. Pat. No. 3,099,304. The Anco No. 832 is a companion of the Anco No. 827 Hydramatic Bacon Slicer fully disclosed in the operating instructions for this machine (revised Oct. 17, 1960), published by the same manufacturer, as well as in commonly assigned U.S. Pat. No. 2,812,792 granted Nov. 12, 1957; U.S. Pat. No. 2,903,032 granted Sept. 8, 1959; and U.S. Pat. No. 2,969,099 granted Jan. 24, 1961. The relevant portions of the slicing machine 12 comprise a supporting table having a platen or feed bed over which the product, such as meat loaf, luncheon meat or other varieites of cold cuts shown at 14, is fed by a pusher or feeder to the slicing blade 15 in order to be sliced and discharged onto the stacker 11, and eventually the weigh-while-convey apparatus 10. The forward or leading edge of the meat product is pressed downwardly against the bed so as to properly engage the blade for slicing. The blade is encased in a housing 19 which serves to protect the operator and particularly the operator's fingers and in addition, prevents the particles of sliced product from being thrown outwardly from the blade by centrifugal force (FIG. 2).

Stacker

The drawings illustrate a stacker embodying the present invention (FIGS. 2 and 4). Stackers of this type are available commercially under the name Anco No. 834 Slice-Stacker and is disclosed in the operating instructions for the Anco No. 834 Slice-Stacker (dated Sept. 17, 1959), published by the manufacturer, the Allbright-Nell Co. of Chicago, Illinois. However, such conventional stacker has been modified as hereinafter described. Furthermore, the stacker of the present invention operates in a different manner, as will be set forth, from such conventional stackers.

With the foregoing in mind, it will become evident that the stacker 11 is driven in timed relationship with the knife shaft 16 of the slicer 12, and receives slices of the product 14, collects them in a stack, and, after the blade has cut the last slice, deposits the stack on the weigh-while-convey apparatus 10 (FIG. 2).

Figure 3:
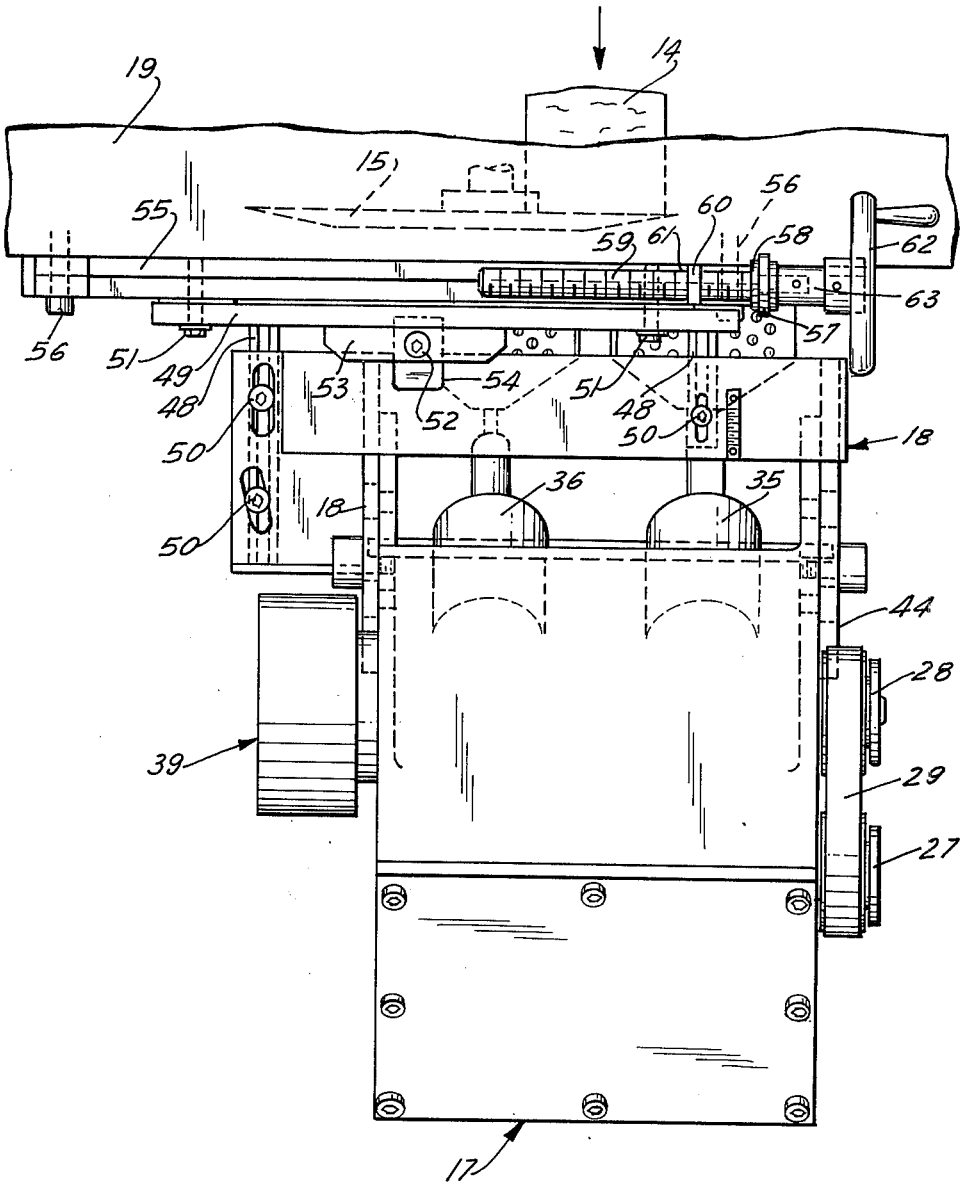
FIG. 3 is a top view of the paddle box and yoke.

The stacker 11 includes a box 17, mounted between a pair of arms of a quadrant bracket 18 adjustably interconnected to the slicer knife guard 19 as hereinafter described (FIGS. 1, 2 and 3). Extending from the paddle box 17 is a pair of paddles 20 and 21 which are ordinarily disposed in slice receiving position below the slicing blade 15. When the preselected number of slices of food product 14 has been stacked on these paddles, the paddles are actuated to deposit the stacks on the weigh-while-convey apparatus 10.

Referring now to the construction of paddles 20 and 21, it will be noted that they are substantially identical and include slice receiving blades or vanes 20*a*, 20*b* and 20*c* and 21*a*, 21*b* and 21*c*, respectively, spaced 120° apart (FIGS. 2, 4 and 6*a*). Upon a signal the paddles will rotate (high speed flip) and virtually come to a stop with the vanes, i.e., 20*a* and 21*a*, in horizontal positions (low vee) or in angular positions with the vanes at an angle above the horizontal (high vee) (FIG. 6*a*). The positions of the mating vanes will be determined by the height of the stacks to be placed on the stacker. Normally a small stack will have a low vee and a large stack will have a high vee.

After rotating (high speed flip) as described above, the paddles continue to move slower (low speed flip) during collection of the required number of slices in the stack (FIG. 6*b*). These blades will rotate at this slow speed about 30° or more, depending upon the requirement for proper stacking. This two speed arrangement, low speed flip and high speed flip, is extremely important in permitting tall stacks to be accumulated and dropped successfully onto the scale, as illustrated in FIGS. 6*a*, 6*b* and 6*c*.

In the conventional paddle stacker, which is stopped while the slices are being stacked, the upper corners of a tall stack would be disrupted by the vanes as they are rotated around to collect the next stack. This occurs because the rotational speed of the paddles is much faster than the gravitational drop of the stack and the corners of the stack remain at a height sufficient to be interfered with by the oncoming surfaces of the vanes. This causes disruption of the stack, poor appearance or destruction of the stack. As the vanes strike the top of the stack, the product is slammed down onto the scale resulting in wild errors in scaling.

In contrast, in the stacker of the present invention, as the slices are being accumulated the vanes are rotated slowly causing the stack, and especially the upper surface at the corners, to be much lower with respect to the center of rotation of the two paddles. In effect, the stack has been dropped sufficiently in height so that its gravitational downward fall after the paddles are rotated at high speed, permits the stack to avoid the oncoming surfaces of the paddles. By using this feature, it is possible to weigh a stack as high as 2½ lbs. This would never have been possible without the twin speed feature. An additional benefit to be gained from this arrangement is that the stack is brought down closer to the scale before it is finally dropped, causing less oscillation of the scale and therefore resulting in a somewhat more accurate reading.

After the high speed flip, the next pair of vanes, i.e., 20*b* and 21*b*, will simultaneously pivot downwardly toward one another and assume the stack receiving position by receiving the next slice out by the blade 15 without cessation of operation of the feeder. Both of the paddles may include a series of apertures 22 in each of their vanes for purposes of increasing their slice gripping and retentive ability to thereby prevent sliding of the lowermost slice of the stack as it is thrown by the blade 15. The paddles 20 and 21 also include the respective mounting posts 23 and 24 which extend into the paddle box 17 (FIG. 4).

The paddles heretofore described and illustrated in the drawings are each provided with three blades spaced 120° apart. Such arrangement has been found to be quite satisfactory and efficient for most stacking requirements. However, it should be understood that the two speed flips can be applied to one blade paddles, although clearly not too desirable, to the conventional four blade paddles where high stacks are not called for, or to two blade paddles. In other words the dual speed will operate with paddles having a plurality of blades evenly spaced apart.

In FIGS. 6*a*, 6*b* and 6*c* the edges of the paddles receiving the slices are shown as curved. This feature is not essential, but it does permit the blades to be moved closer to the slicing knife and, provides a better surface to receive the first slice of product, and prevents the straight edge from digging into the first slice. Since the curved edges of the two mating paddles are turned inwardly, it will be apparent that there must be a right and left paddle to assure that the curves are in the right directions. This necessitates proper mounting of the right and left paddles in the paddle holders of the paddle box. In such case the mounting posts 23 and 24 can be varied in any conventional manner to avoid improper insertion of the paddles in the paddle holders.

The paddle box 17 includes a housing 25 containing a motor 26 which drives a pulley 27 which in turn drives a second pulley 28 through a timing belt 29 running over the two pulleys (FIG. 4). The second pulley 28 is affixed to and drives a shaft 30 passing through the housing from one side to the other. Connected to the shaft 30 are a pair of bevel gears 31 and 32 which engage another pair of bevel gears 33 and 34 which are connected to and rotate the paddle holders 35 and 36. The paddle holders have bores to receive the mounting posts 23 and 24 of the paddles 20 and 21. Each paddle post is retained within the bore by key means 37 and is biased outwardly by means of a compression spring 38. Other conventional means may be used for affixing the paddles to the paddle holders.

Figure 5:
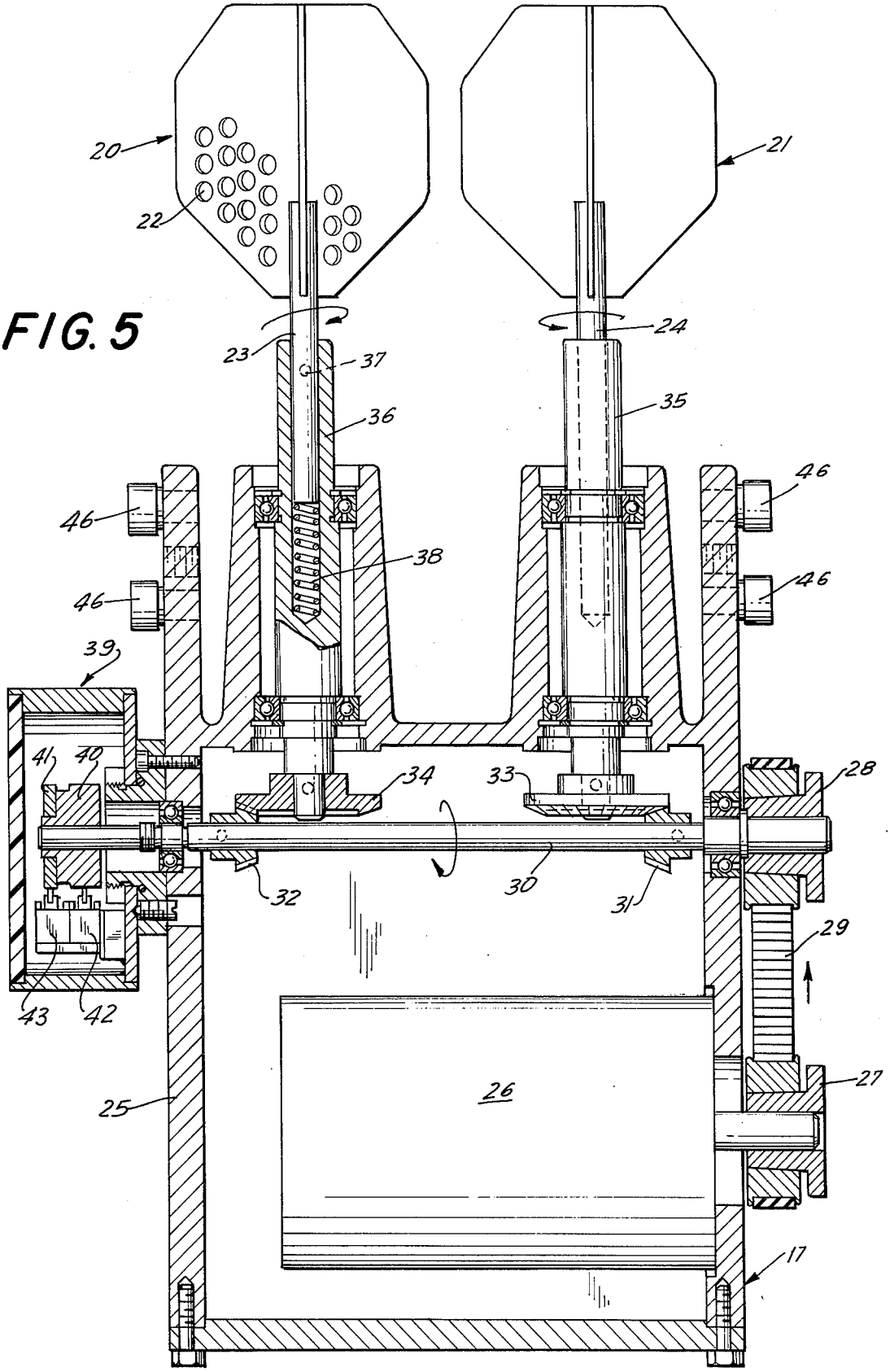
FIG. 5 is a sectional view of the paddle box taken along the line 5—5 of FIG. 4.

Affixed to the paddle box 17 is a paddle encoder 39 having a fixed cam 40 secured to the shaft 30 which drives the paddles (FIG. 5). Affixed to the fixed cam 40 is an adjusting cam 41 which can be varied with respect to the fixed cam 40 to adjust the angles of the vanes of the paddles. As the two cams rotate they engage switches 42 and 43, switch 42 being the low speed cutoof and switch 43 being the high speed cutoff. As arranged, one revolution of the cams will cause one flip of the paddles and three flips (for the three blade paddles) will turn the paddles one revolution.

The paddle box 17 is slidably set for adjustment between a pair of arms 44 of the quadrant bracket 18 (FIGS. 1, 2 and 3). Such arms are each formed with an arcuate slot 45 within which are adapted to travel rods 46 extending from the paddle box housing 25. A threaded nut-type clamp assembly 47 secures the paddle box 17 relative to the arms 44 upon the attainment of the desired angular orientation of the paddles 20 and 21 relative to the slicing machine 12.

The quadrant bracket 18 is slidably affixed to a pair of slotted arms 48 projecting from a plate member 49 (FIG. 3). Screw-clamp assemblies 50 affix the quadrant bracket 18 to the plate member 49 and permit the quadrant bracket to be moved inwardly or outwardly with respect to the slicing machine 12.

The plate member 49 is slidably affixed to a slide member 55 with screw-clamp assemblies 51 passing through slots in such plate member 49 so that the plate member 49 and attached quadrant bracket 18 can be moved upwardly or downwardly with respect to the blade of the slicing machine 12. To facilitate such vertical movement the plate member 49 is provided with a vertical adjusting screw 52 threaded into a bracket 53 projecting from the top of the plate member 49. The end of such vertical adjusting screw is anchored in a guide block 54 affixed to the slicer knife guard 19.

The slide member 55 is affixed to the slicer knife guard 19 with screws 56 (FIGS. 2 and 3). Projecting upwardly from one end of the slide member 55 is a support 57 which has a hole 58 through which passes an unthreaded end of a horizontal centering screw 59. Projecting upwardly from the plate member 49 is a plate 60 which has a threaded hole 61 through which passes a threaded portion of the horizontal centering screw 59. As the centering screw 59 is turned it moves the plate member 49 and affixed quadrant bracket 18 horizontally with respect to the slicing machine 12. The unthreaded end of the centering screw 59 is anchored against lateral movement with respect to support 57. Such end is provided with a handwheel 62 spaced from the support 57 by a spacer 63.

It will thus be apparent that the heretofore described mounting for the paddle box provides for easy and rapid adjustment of the position of the paddles with respect to the slicer blade 15. Such adjustments permit horizontal or transverse, vertical, angular in and out movements so that the paddle can be conveniently set in the most desirable positions for the particular slicing operation. The prime purpose of such adjustments is to insure that the slices will land in the center of the matching paddles, that the slices will land in the same relative position and are not forming an uneven sloping stack, and that the stack will be neat in appearance.

The motor to rotate the paddle at dual speed is a low inertia D.C. motor with feedback and a built-in tachometer. This motor is an important part of the invention in that it permits the paddles to operate at the desired low speed while the slices are being stacked and be synchronized with the speed of the slicer and then be speeded up to the desired high speed to drop the stack of slices and bring the next set of blades into position to start another stack.

Such motor 26 for the stacker paddles is synchronized with the speed of the slicer. The slicer is set to run to provide the desired slice count and the number of stacks per minute. By synchronizing the stacker motor with such slicer speed the paddles, after rotating at the high speed flip, are in position to receive the slices from the slicer during the low speed flip. During such low speed flip the downward rotation of the paddles should approximately equal the thickness of each slice as it lands. When the correct stack is achieved the high speed flip occurs and the paddles rotate 120° to bring the next pair of paddles into position to receive the slices for the next stack. Of course, where there are other than three blades on the paddles the rotation will have to be modified to take care of the distance such blades will travel. As heretofore pointed out the distance the paddles travel during the low speed flip before the high speed flip occurs is adjusted according to the desired stack by adjusting the cams on the encoder nearer or further from one another.

The operation of the stacker of the present invention in connection with the slicer, stacking and weighing machine for food products should be apparent from the foregoing description and the drawings.

Thus, the several objects and advantages are most effectively attained. Although several somewhat preferred embodiments of the invention have been disclosed and described in detail herein, it should be understood that the invention is in no sense limited thereby and its scope is to be determined by that of the appended claims.

What is claimed is:

1. In combination a slicing maching having a slicing blade, a feeding means for feeding a product to be sliced by said blade and control means for determining the rate of advance of said feeding means toward said blade, and consequently the sliced thickness, and apparatus for stacking slices of said product as they are discharged by said slicing machine and then transferring the stacks of sliced product, said apparatus comprising in combination:

a paddle stacker to be located adjacent to the discharge end of said slicing machine for receiving the slices discharged therefrom;

a low inertia D. C. motor to rotate the paddles of the paddle stacker at low speed as the slices are being stacked on such paddles and at high speed when the desired size of stack has been achieved, said motor at low speed being synchronized with the rate of advance of said slicer feeding means;

control means coupling the said motor and the paddle stacker for actuating said motor when the desired size of stack has been achieved and rotating the paddles at high speed to transfer the said stack and bring the paddles to the low speed position ready for reception of another stack of slices;

stack receiving means adapted to receive thereon the stacks of sliced product transferred by said stacker.

2. The invention in accordance with claim 1 wherein the paddle stacker comprises a pair of mating paddles with equally spaced vanes on each paddle, the two paddles being positioned so that upon rotation one vane of one paddle will align with a corresponding vane of the other paddle to provide surfaces to receive the slices from the slicing machine.

3. The invention in accordance with claim 2 wherein the paddles will rotate approximately through 30° during the downward movement at low speed as the slices are being stacked on such paddles.

4. The invention in accordance with claim 1 wherein the paddles, as the slices are being stacked on such paddles, will move downward for each slice a distance approximately equal to the thickness of such slice.

5. The invention in accordance with claim 1 wherein, after the high speed downward movement of the paddles and preparatory to receiving the first slice of a stack, the aligned vanes of the two paddles form an inverted V on which the first slices of the stack will be received.

6. The invention in accordance with claim 1 wherein, after the high speed downward movement of the paddles and preparatory to receiving the first slice of a stack, the aligned vanes of the two paddles will be substantially in the same plane to receive the first slices of the stack.

7. The invention in accordance with claim 2, wherein each paddle has three equally spaced vanes and the paddles will rotate approximately 120° during the low speed and high speed movements between the completions of stacks.

8. The invention in accordance with claim 2 wherein each paddle has two equally spaced vanes.

9. The invention in accordance with claim 1 wherein the control means comprises cam means rotatable by the motor rotating the paddles and electric switches engageable by the cams, which switches actuate the motor for high speed and low speed.

10. The invention in accordance with claim 2 wherein the edges of the blades of the mating paddles are curved downwardly to provide a smooth surface to receive the first slice deposited on the paddles and to permit the paddles to be placed closer to the slicing blade.

11. The invention in accordance with claim 1 wherein the paddle stacker is slidably affixed to members projecting outwardly from the slicing machine whereby the paddle stacker can be moved inwardly and outwardly with respect to the slicing machine.

12. The invention in accordance with claim 1 wherein the paddle stacker is affixed to a member running cross-wise of the slicing machine, which member is provided with screw adjusting means, whereby the paddle stacker can be adjusted in a cross-machine direction with respect to the slicing machine.

13. The invention in accordance with claim 1 wherein the paddle stacker is affixed to a member running vertically of the slicing machine, which member is provided with screw adjusting means, whereby the paddle stacker can be adjusted upwardly and downwardly with respect to the slicing machine.

14. The invention in accordance with claim 1 wherein the said motor rotates the paddles of the paddle stacker through an assembly comprising a shaft driven by a timing belt connected to the motor and shaft and bevel gears connected to the shaft and paddle holders for the paddles.

* * * * *